US005397194A

United States Patent [19]

Yuan et al.

[11] Patent Number: 5,397,194

[45] Date of Patent: Mar. 14, 1995

[54] FOUNTAIN CLEANING DEVICE

[76] Inventors: Henry S. Yuan; Wen R. Yuan, both of 688 N. Rimsdale Ave., Covina, Calif. 91722

[21] Appl. No.: 185,045

[22] Filed: Jan. 24, 1994

[51] Int. Cl.[6] ..... A47L 13/17; A46B 11/02

[52] U.S. Cl. ..... 401/186; 401/183; 401/263; 401/266; 401/271

[58] Field of Search ..... 401/183, 186, 266, 263, 401/271

[56] References Cited

U.S. PATENT DOCUMENTS

| | | | |
|---|---|---|---|
| 233,238 | 10/1880 | Halbert | 401/186 |
| 595,910 | 12/1897 | Fili, Jr. | 401/266 |
| 1,208,623 | 12/1916 | Nakashima | 401/266 |
| 1,916,649 | 7/1933 | Appleford | 401/263 |
| 2,204,200 | 6/1940 | Wisner | 401/266 X |
| 2,886,916 | 5/1959 | Rossi | 401/266 |
| 3,256,894 | 6/1966 | Sherman | 401/271 X |

FOREIGN PATENT DOCUMENTS

| | | | |
|---|---|---|---|
| 878836 | 6/1953 | Germany | 401/263 |

*Primary Examiner*—Steven A. Bratlie
*Attorney, Agent, or Firm*—Thomas I. Rozsa; Tony D. Chen

[57] ABSTRACT

A fountain cleaning device for washing articles as, for example, vehicles, bathtubs or shop fronts the device comprises a reservoir, compressible in the direction perpendicular to a surface to be cleaned, and includes a one-way flow control mechanism, which allows a cleaning solution contained therein to be dispensed under an external compression and seals the liquid upon the release of the pressure. A scrubbing medium is attached to the undersurface of the reservoir.

14 Claims, 3 Drawing Sheets

FOUNTAIN CLEANING DEVICE

BACKGROUND

1. Field of Invention

This invention relates to a fountain cleaning device, particularly adapted for hand-washing articles including vehicles, windows, bathtubs and numerous other surfaces.

2. Description of the Prior Art

Cleaning activities in homes or businesses commonly require that a surface is scrubbed with a liquid cleaning agent then followed by water rinse.

A typical example is hand-washing an automobile. In an "old" way, a piece of sponge or cloth soaked in a bucket filled with soap and water was used to scrub the car, then a garden hose to rinse it out. Since the sponge is saturated with suds on every dip inside the bucket, the natural compressive action generated during the scrubbing movements tends to release too much cleaning solution from the sponge at one time and hence increase the repeated needs of dipping the sponge in the bucket during the car wash. Also, the operator's entire hand is inevitably in contact with the cleaning solution used during the wash, thus may subject to some undesirable effects on the skin of the operating hand, such as becoming over-dry or rough.

Over the years, hand-held washing devices, many coupled with water supply through an ordinary garden hose as their suds dispensing means, have been proposed, such as disclosed in the U.S. Pat. No. 3,070,826 to Paterno (1963), to Kundel U.S. Pat. No. 1,655,375 (1928) and to Cheron U.S. Pat. No. 1,676,857 (19280, which all show this type of arrangement.

However, due to the garden hose attachment while in use, this type of devices is clumsy to operate as a hand-held cleaning tool, even though it minimizes the need of the operator's hand being in contact with the cleaning solution during the wash. In addition, it uses much more detergent than a car wash really needs.

The U.S. Pat. No. 2,932,840 to Lathrop (1960) describes a fountain cleaning device with a "squeeze bottle" type of arrangement to clean upholstery. But this assembly is not suitable for washing automobiles or for many other applications partly because the "squeeze bottle"—type design is not capable of dispensing its content continuously as the device is less than full and is held in the positions of between vertical and upside down. The device, as filled with a cleaning solution, could drip during storage or in idle during cleaning due to its open perforations in its chamber wall. In addition, since the "squeeze bottle", also designed to be used as an elongated handle, has limited liquid capacity, and it needs frequent refill during cleaning, or the handle has to be made too big for an operator's hand to grasp.

Bernard U.S. Pat. No. 3,960,294 (1976) illustrates a liquid applicator-type dispenser with a compressible bag arrangement, which is tedious to set up, of too many component parts, and relatively expensive to manufacture.

For the lack of a better and portable device, the "old" way of automobile wash as mentioned is still found in widespread use.

SUMMARY OF THE INVENTION

Accordingly, several important objects and advantages of this invention are:

a. to provide a cleaning device which has an improved means to dispense a liquid cleaning solution from a compressible reservoir through an improved one-way flow control assembly and scrubbing medium, thus eliminating the need of a garden hose attachment during cleaning;

b. to provide a cleaning device which can be operated in such a way that a liquid cleaning solution is extruded onto a surface being cleaned in a continuous stream as the device is held in any operating position, vertical, horizontal or inclined at an angle during scrubbing;

c. to provide a cleaning device which requires the use of only one hand to operate;

d. to provide a cleaning device of this character that is easy to set up, convenient, efficient, and portable to use;

e. to provide a cleaning device which can be filled with a cleaning solution anywhere, including indoors because, due to the improved one-way flow control mechanism, the unit will not drip by itself; which, as dried after use, remains dry during storage even it is full, and can be used right away next time when one is in hurry;

f. to provide a cleaning device which, when used for automobile wash, for example, does not need refilling for at least one car wash;

g. to provide a cleaning device which virtually eliminates the need of the operator's hand being in contact with the cleaning solution;

h. to provide a cleaning device which, when used for vehicle wash, for example, uses at least ten times less the cleaning solution than either the existing hand-held washing devices or the "old" way of automobile wash.

i. The material forming the improved scrubbing medium, which is directly in physical contact with surfaces to be cleaned, is not limited to permeable or bristle-type materials, such as the common sponge or brush. It can be made from a non-porous material of soft nature if so desired in an application.

Further objects and advantages are to provide a cleaning device of this character that is simple and rugged in construction, and capable of a relatively long working life. Further objects and advantages are to provide a cleaning device which is inexpensive to manufacture, and once in service, is easy to maintain. Still further objects and advantages of my invention will become apparent from a consideration of the drawings and ensuing description of it.

DESCRIPTION OF THE PREFERRED EMBODIMENT

Figure 1:
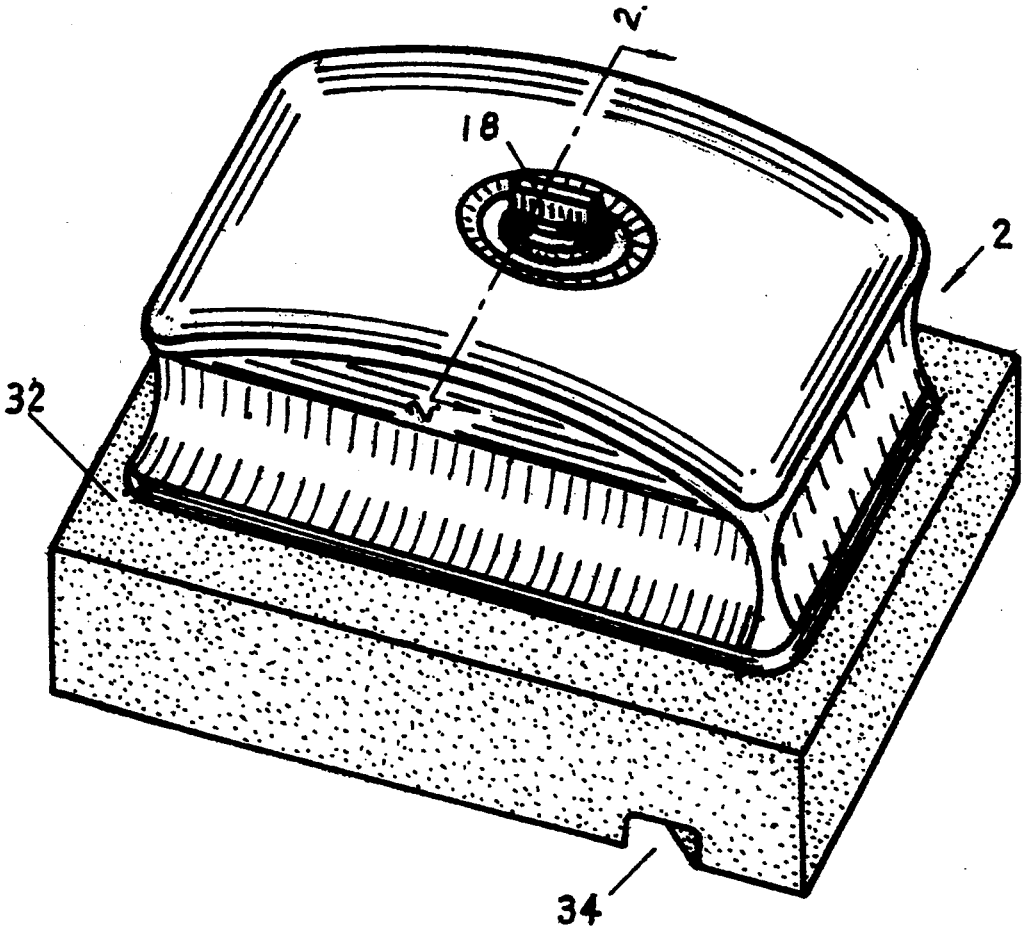
FIG. 1 is a perspective view of the fountain cleaning device comprising the invention.

A preferred embodiment of the fountain cleaning device of the present invention is illustrated in the drawings. Referring to them by numerals, 1 indicates generally a reservoir 2, closed by a cap 18, attached to a scrubbing member 32 while 2, 3 and 4 show the details of the one-way flow control assembly 27 and the configuration of scrubbing member 32. Now, more particularly referring to FIG. 1 and FIG. 2, reservoir 2 has end walls 6 and 8, both have flat surfaces facing the inside of container 2. Side wall 4 is concave-shaped all around and toward the inside of reservoir 2. Reservoir 2 is preferably of a molded elastomeric or rubber material and its side wall 4 is much thinner structurally than end walls 6 and 8 so that side wall 4 is considerably flexible and end walls 6 and 8 are relatively rigid.

Figure 2:
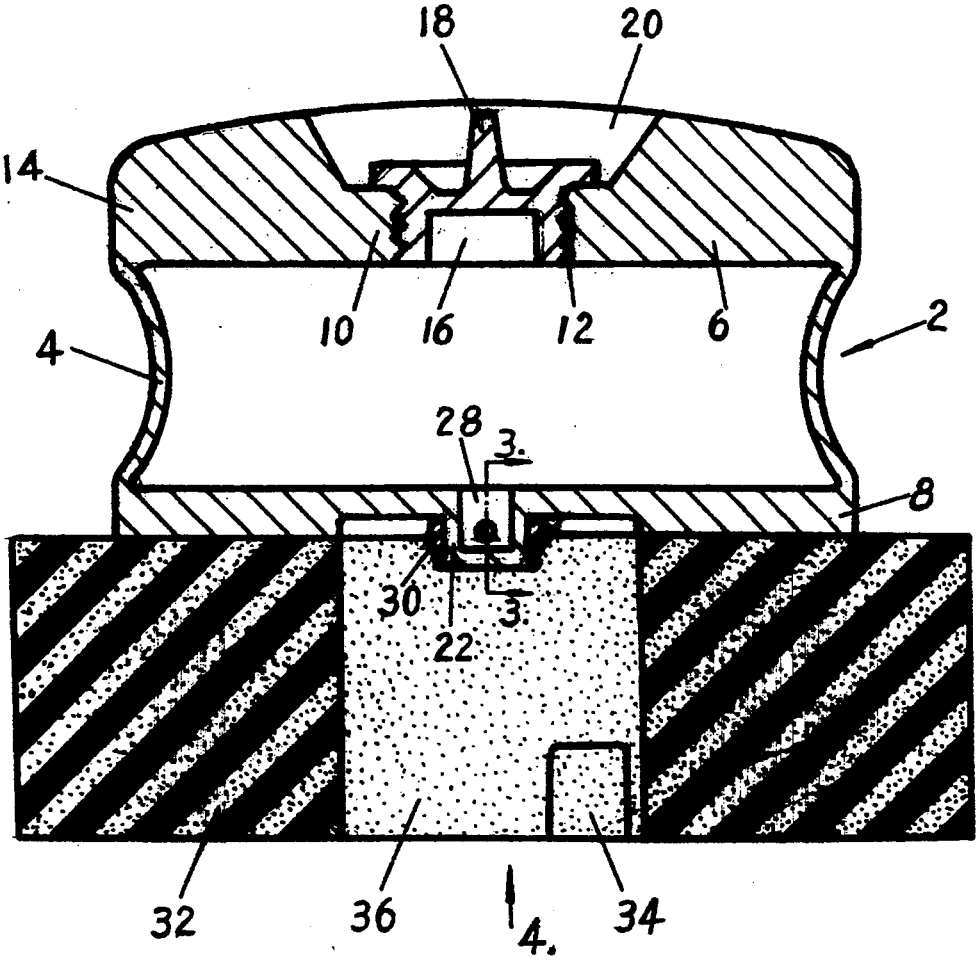
FIG. 2 is a section view taken through the center of the unit along the lines 2—2 of FIG. 1.

Cap housing 10 is provided with a threaded portion 12 which receives cap 18 as illustrated in FIG. 1 and FIG. 2. A fill opening 16, disposed in the central area of top wall 6, goes through housing 10, and is communicating with reservoir 2 and passage 20 as cap 18 is removed for filling. Preferably formed integral with the upper portion of top wall 6 and cap housing 10 is a handle portion 14, embodying passage 20, which is in a tapered, elliptical-cylinder shape and is above and concentric with fill opening 16. Also, handle portion 14 is preferably convex-shaped to fit the contour of the inner area of a human hand while being grasped, and structurally reinforces wall 6. In other embodiment, cap 18 may be optionally replaced by an elongated handle with a threaded portion at one end, which will be in a threaded engagement with fill opening 16, as to help an operator to clean places one's hand can not reach.

Figure 3:
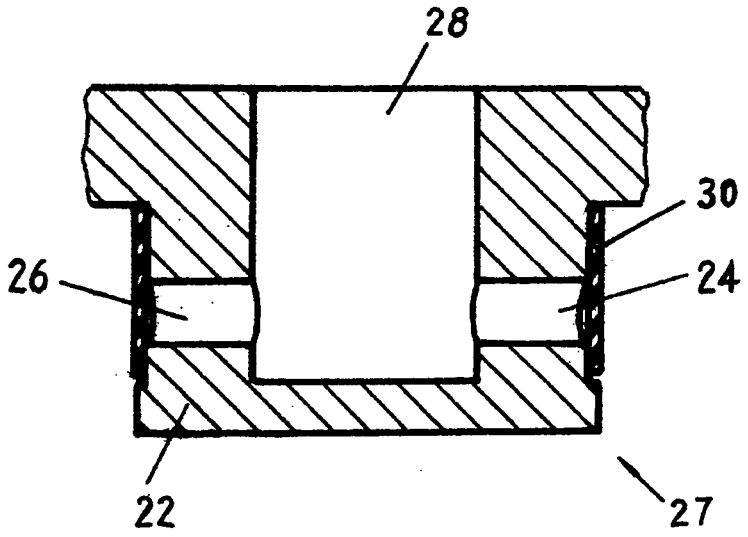
FIG. 3 is a partially sectioned view on an enlarged scale showing the one-way flow control assembly.
Figure 4:
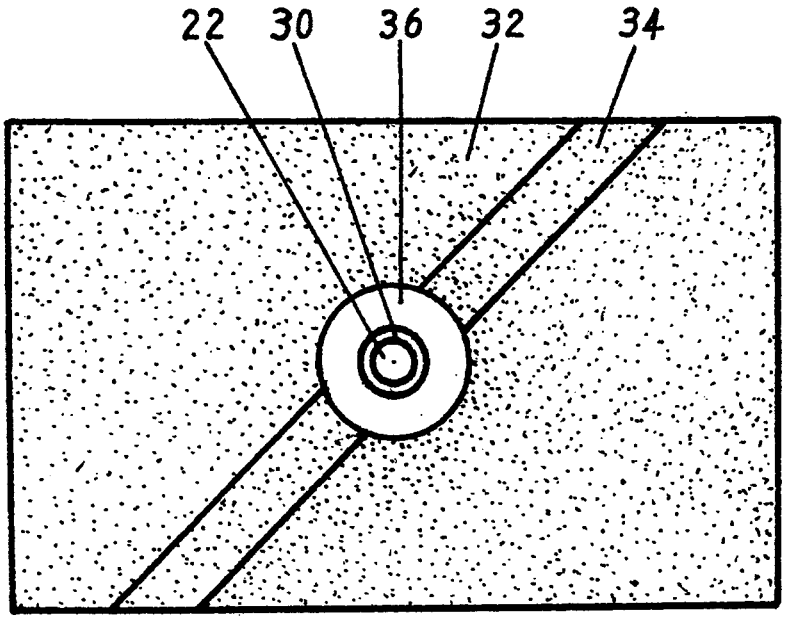
FIG. 4 is an end view of the unit.

Referring to FIG. 2 and FIG. 3, disposed in and preferably integral with the central area of bottom wall 8, is a cylindrical extension member 22 embodying conduit 28, which terminates at the closed, outer end of extension member 22, and is normally communicating with reservoir 2 and a plurality of perforations such as 24 and 26. As shown in FIG. 3 and FIG. 4, a band 30, encircling extension member 22 and completely covering over perforations 24 and 26, is preferably made of a rubber or the like material. Further, the inside diameter of band 30 is slightly smaller than the outside diameter of extension portion 22 where band 30 covers so that the right amount of tension, thus produced in band 30 as properly installed as shown, allows the liquid inside reservoir 2 to be dispensed only under the compression generated while the unit is in scrubbing operation and seals the liquid flow when the pressure is released.

Scrubbing member 32, made of preferably a high density sponge, such as polyurethane for washing automobiles or other suitable materials such as a bristle brush in case for scrubbing hard, heavily-soiled surfaces, is normally bonded to the undersurface of reservoir 2 preferably by a suitable adhesive as shown in FIG. 1 and FIG. 2. Disposed in the central area of scrubbing medium 32, a through-hole 36 is so formed as being concentric with and enclosing one-way flow control assembly 27, which is thus surrounded by scrubbing medium 32. Opposite the adhesive bonding side, a diagonally groove 34, across the full length of scrubbing block 32 and connecting through-hole 36, is so configured as to facilitate the dispensing and foam formation as a result of the admission of the air to the interface between the cleaning device and a surface being scrubbed. In other embodiments, there may be more than one diagonally groove connecting through-hole 36. Groove 34 may be formed by machining, scoring or other suitable methods.

Based on the description above, a number of advantages of the present invention fountain cleaning device become evident:

(a) The reservoir of my cleaning device, enclosed by the thin, thus flexible side wall and relatively thicker end walls, can be compressed only in the direction perpendicular to a surface to be cleaned by the hand pressure applied while grasping the device during scrubbing operations. The cleaning solution contained in the unit can be almost completely dispensed for cleaning purpose.

(b) Being made of entirely a flexible material, the reservoir of the unit can bend slightly together with the attached scrubbing member under the action of the scrubbing movements to help clean a curved or non-flat surface.

(c) With the use of the improved compressible reservoir mounted on the scrubbing medium in combination use with the curved handle, one can operate the present invention fountain cleaning device in scrubbing applications, such as hand-washing automobiles, with great ease no matter what position the device is held, vertical, horizontal or inclined at an angle without the need of the hand being in contact with the cleaning solution.

(d) The one-way flow control mechanism gives a user flexibility, portability and efficiency in operating and storage of the device once in service without unnecessary dripping and wasting of cleaning solution.

In the operation of the present invention, one first unscrews cap 18 off the cleaning unit if empty, pour a small amount of a cleaning detergent through fill opening 16, and then fill the unit up with common tap water. Passage 20 in the tapered, elliptical-cylinder shape above fill opening 16 functionally serves as a funnel for facilitating filling. The device is now ready to use after cap 18 is screwed back on. The detergent and the water will mix well inside reservoir 2 during subsequent scrubbing movements.

The manner of using the fountain cleaning device for scrubbing is identical to that for a common sponge or brush in present use. During the scrubbing movements, the cleaning solution contained in reservoir 2 is extruded, through conduit 28, perforations 24 and 26, under band 30 and then through-hole 36 onto a surface being cleaned simultaneously with the hand compression on the cleaning device. Groove 34 on scrubbing member 32 is so formed as to facilitate the dispensing and foam formation as a result of the admission of the air to the interface between the cleaning unit and a surface being scrubbed. Concave-shaped side wall 4 is so formed as to somehow minimize its sway under the scrubbing movements and help it become uniformly and easily compressible against the presence of the internal static fluid pressure as a result of hand compression while scrubbing. Preferably being made of entirely a flexible material, the end walls, especially bottom wall 8 will bend slightly, facilitating scrubbing member 32 for a reasonable fit to any curved or non-flat surfaces. Due to its elastic nature, band 30, installed as shown, expands slightly and allows the liquid flow under applying pressure on the unit, then retracts and seals the liquid as soon as the compression is released.

Through-hole 36, in the combination use with groove 34, facilitates the even spread of the cleaning solution applied over a surface to be cleaned, and minimizes any unnecessary dripping, and thus wasting of the solution from the sides of the scrubbing member as the device is not held in a horizontal position.

Normally, after finishing scrubbing dirty objects using the present invention, one rinses the object surfaces with clean water from a common garden hose or other means. The device can be filled right after or before next use with a cleaning solution or a combination of a concentrated cleaning agent and water.

The present invention fountain cleaning device provides a highly portable, reliable, yet economical unit which can be operated with great ease. Once filled, the cleaning device of the invention can be used to efficiently scrub dirty surfaces with the cleaning solution being dispensed therefrom simultaneous with the scrubbing movements, no matter what position it is being held without the wasteful dripping. It virtually eliminates the need of one's hand being in contact with the cleaning solution, and especially the garden hose attachment, for example, for a vehicle wash. The device can be stored even when full.

While the above description contains many specificities, these should not be construed as limitations on the scope of the invention, but as merely providing illustrations of preferred embodiments thereof. Many other variations are possible. For example, the reservoir can have other shapes, such as oval, circular, trapezoidal, square, etc.; the scrubbing member can have other shapes; the cap as shown can be replaced by an elongated handle of different shapes.

Thus, the scope of the invention should be determined not by the embodiments illustrated, but by the appended claims and their legal equivalents.

What is claimed is:

1. A cleaning device for dispensing fluid, comprising:

a. a container having a lower portion with a bottom wall, an upper portion with a top wall and at least four flexible sidewalls such that the top and bottom walls, and the at least four flexible sidewalls define a chamber for containing said fluid, the upper portion having an opening for allowing said fluid to be poured into the chamber, the lower portion having a conduit projecting outwardly away from the chamber into an extension portion underneath the bottom wall, where the container can be easily compressed in a direction perpendicular to a surface to be cleaned;

b. said extension portion having a plurality of perforations for allowing said fluid to flow out from said chamber;

c. a cap threadedly engaged with said opening at said upper portion for retaining said fluid within said chamber;

d. a one-way flow control means removably attached and encircling said extension portion and completely covering over said plurality of perforations, the one-way flow control means controlling the amount of said fluid to be dispensed under an external compression on said cleaning device; and e. a scrubbing member securely attached to said lower portion of said container and having a hole therethrough and at least one diagonal groove such that said extension portion of said container is inserted into the hole and the at least one diagonal groove intersecting the hole for facilitating the dispensing and foam formation of said fluid.

2. The cleaning device as defined in claim 1 wherein said container is made of elastic material.

3. The cleaning device as defined in claim 1 wherein said container is made of flexible material.

4. The cleaning device as defined in claim 1 wherein said one-way flow control means is a band.

5. The cleaning device as defined in claim 4 wherein said band is made of elastic material.

6. The cleaning device as defined in claim 1 wherein said upper portion of said container forms a handle for grasping said cleaning device.

7. The cleaning device as defined in claim 1 wherein said at least four flexible sidewalls are concave shaped projecting inwardly toward each other for allowing said container to be compressed.

8. A fountain cleaning device for dispensing liquid soap, comprising:

a. a reservoir having a lower portion with a rigid bottom wall, an upper handle portion with a rigid top wall and four concave shaped flexible sidewalls projecting inwardly toward each other such that the top and bottom walls, and the four concave shaped sidewalls define an interior chamber for containing said liquid soap, the upper handle portion having a fill opening for allowing said liquid soap to be poured into the interior chamber, the lower portion having a conduit projecting outwardly away from the interior chamber into an extension portion underneath the bottom wall, where the reservoir can be easily compressed in a direction perpendicular to a surface to be cleaned;

b. said extension portion having a sidewall with a plurality of perforations for allowing said liquid soap to flow out from said interior chamber;

c. a cap member threadedly engaged with said fill opening of said top wall for retaining said liquid soap within said interior chamber;

d. a one-way flow control mechanism having a band made of elastic material removably attached and encircling said sidewall of said extension portion and completely covering over said plurality of perforations, the one-way flow control mechanism controlling the amount of said liquid soap to be dispensed under an external compression on said cleaning device; and e. a scrubbing member having a top surface, a bottom surface and a hole therethrough, the top surface securely attached to said lower portion of said reservoir such that said extension portion of said reservoir is inserted into the hole, the bottom surface having a diagonal groove extending from a respective side of the scrubbing member to another respective side of the scrubbing member and intersecting the hole for facilitating the dispensing and foam formation of said liquid soap.

9. The fountain cleaning device as defined in claim 8 wherein said reservoir is made of elastic material.

10. The fountain cleaning device as defined in claim 8 wherein said reservoir is made of flexible material.

11. The fountain cleaning device as defined in claim 8 wherein said scrubbing member is made of sponge rubber.

12. The fountain cleaning device as defined in claim 8 wherein said top and bottom end walls are structurally thicker than said sidewall.

13. The fountain cleaning device as defined in claim 8 wherein said upper handle portion further comprises a tapered elliptical-cylindrical shaped passage for allowing said cap to be threadedly engaged with said fill opening such that said cap is flushed with said upper handle portion.

14. The fountain cleaning device as defined in claim 8 wherein said extension portion is integrally formed with said bottom wall of said reservoir.

* * * * *